US009901797B2

(12) United States Patent
Piggott

(10) Patent No.: US 9,901,797 B2
(45) Date of Patent: Feb. 27, 2018

(54) BALL STRIKING APPARATUS

(71) Applicant: Warren Laurence Piggott, Oxenford (AU)

(72) Inventor: Warren Laurence Piggott, Oxenford (AU)

( * ) Notice: Subject to any disclaimer, the term of this patent is extended or adjusted under 35 U.S.C. 154(b) by 0 days.

(21) Appl. No.: 14/915,904

(22) PCT Filed: Sep. 2, 2014

(86) PCT No.: PCT/AU2014/000863
§ 371 (c)(1),
(2) Date: Mar. 2, 2016

(87) PCT Pub. No.: WO2015/027285
PCT Pub. Date: Mar. 5, 2015

(65) Prior Publication Data

US 2016/0199711 A1 Jul. 14, 2016

(30) Foreign Application Priority Data

Sep. 2, 2013 (AU) ..... 2013903342

(51) Int. Cl.

| | |
|---|---|
| ***A63F 9/00*** | (2006.01) |
| ***A63B 59/50*** | (2015.01) |
| ***A63D 3/00*** | (2006.01) |
| ***A63D 3/02*** | (2006.01) |
| *A63F 9/02* | (2006.01) |
| *A63F 7/24* | (2006.01) |

(52) U.S. Cl.
CPC ..... *A63B 59/50* (2015.10); *A63D 3/00* (2013.01); *A63D 3/02* (2013.01); *A63F 7/2409* (2013.01); *A63F 7/249* (2013.01); *A63F 2009/0265* (2013.01)

(58) Field of Classification Search
CPC .... A63F 7/2409; A63F 7/2472; A63F 7/2481; A63F 7/249
USPC ..... 273/317.7, 317.9, 355–357, 108.21, 273/108.52, 108.54, 108.55, 129 R, 273/129 W
See application file for complete search history.

(56) References Cited

U.S. PATENT DOCUMENTS 844,507 A * 2/1907 Falvey ..... A63F 9/02 124/26
1,080,670 A * 12/1913 Zimmerman ..... A63B 69/408 124/16
1,588,440 A * 6/1926 Boosey ..... A63F 7/0608 273/317.9
2,160,299 A 5/1939 Zinngrabe
(Continued)

*Primary Examiner* — Mark Graham
(74) *Attorney, Agent, or Firm* — Eagar & Martin Pty Ltd

(57) ABSTRACT

A ball striking apparatus comprises a ball strike member arranged on a free end of a resiliently flexible arm(s). The free end of the arm(s) can be drawn back manually and subsequently released to drive the bail strike member through a primary impact zone so that the ball strike member can strike a ball in the primary impact zone. The resiliently flexible arm is mounted at one end to a support structure with the opposite, free end adjacent the primary impact zone. The support structure is fastened to an edge of a table that defines a playing surface. A bail support arrangement is configured to support the ball in the primary impact zone such that the ball can be struck by the ball strike member and driven away from the primary impact zone.

16 Claims, 10 Drawing Sheets

(56) References Cited

U.S. PATENT DOCUMENTS

| | | | | | |
|---|---|---|---|---|---|
| 2,596,557 | A | * | 5/1952 | Huber | A63F 7/06 124/42 |
| 3,118,673 | A | * | 1/1964 | Maurer | A63F 7/2472 273/108.55 |
| 3,787,053 | A | * | 1/1974 | Breslow | A63F 9/02 124/16 |
| 3,834,703 | A | * | 9/1974 | Dlouhy | A63F 7/0608 124/4 |
| 4,042,239 | A | * | 8/1977 | Cecchetti | A63F 7/0684 273/108.52 |
| 4,078,800 | A | * | 3/1978 | Goldfarb | A63F 7/0608 124/16 |
| 4,936,579 | A | | 6/1990 | Barlow | |
| 5,069,460 | A | * | 12/1991 | Kulesza | A63F 7/06 273/108.22 |
| 5,763,761 | A | | 6/1998 | Parente et al. | |
| 6,019,095 | A | * | 2/2000 | Sommer | A63D 3/02 124/4 |
| 6,682,071 | B1 | * | 1/2004 | Carsten | A63F 7/249 273/108.1 |
| 7,207,564 | B2 | * | 4/2007 | Bedford | A63B 69/40 273/108.1 |

* cited by examiner

BALL STRIKING APPARATUS

FIELD

The following specification describes exemplary embodiments of a ball striking apparatus and an apparatus for playing a game using the ball striking apparatus.

SUMMARY

According to various exemplary embodiments, there is provided a ball striking apparatus that comprises a support structure;

at least one resiliently flexible arm that is mounted at one end to the support structure with an opposite, free end adjacent a primary impact zone;

a ball strike member that is arranged on the opposite free end of the arm(s) so that the free end of the arm(s) can be drawn back manually and subsequently released to drive the ball strike member through the primary impact zone so that the ball strike member can strike a ball in the primary impact zone; and a ball support arrangement configured to support the ball in the primary impact zone such that the ball can be struck by the ball strike member and driven away from the primary impact zone.

The ball striking apparatus may include a fastening assembly for fastening the support structure to an edge of a table that defines a playing surface.

The support structure may include an elongate stanchion with the fastening assembly arranged on one end of the stanchion so that the stanchion extends generally orthogonally with respect to the playing surface when mounted on said edge and the arm(s) are mounted on an operative upper end of the stanchion.

The stanchion may be generally rectangular and may define an opening. The arm(s) may be positioned on a proximal side of the opening and the primary impact zone may be located in the opening and/or on a distal side of the opening.

The ball strike member may be arranged on the free end of the arm to extend at least partially into the opening when the arm(s) is in a released condition.

The ball strike member may have a profile that is selected to impart a degree of deflection to the ball when striking the ball.

The ball support arrangement may include a ball support assembly that is mounted on a distal side of the support stanchion. The ball support assembly may be configured to support a tee in the primary impact zone.

The ball support assembly may be configured to support the tee in a range of positions in the impact zone.

The ball striking apparatus may include a number of flexible arms mounted on the support stanchion such that a user can select one of the arms for striking the ball.

A striking device may be mounted on the upper end of the stanchion. The striking device may define the number of flexible arms extending from a hub in a spoke-like manner, the striking device being rotatable so that a user can rotate the device to select one of the arms for striking the ball.

The ball strike members on each arm may have different profiles so that a user can select a degree of deflection to be applied to the ball when struck.

The ball striking apparatus may include a secondary ball support arrangement configured to support the ball in a secondary impact zone above or higher than the primary impact zone. The secondary ball support arrangement may include an upper support member that is mounted on a distal side of the support stanchion, the upper support member being configured to support a tee in the secondary impact zone.

According to various exemplary embodiments, there is provided an apparatus for playing a game, which comprises the ball striking apparatus as described above and a table that defines a playing surface so that the apparatus can be mounted on an edge of the table and the ball can be driven towards an opposite edge of the table.

DESCRIPTION OF THE EMBODIMENTS

Figure 1:
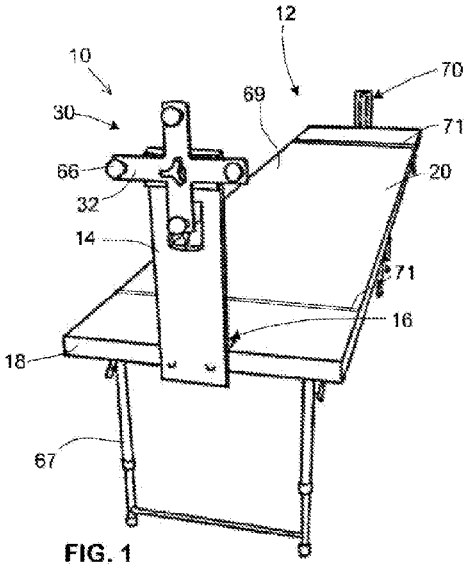
FIG. 1 shows an exemplary embodiment of an apparatus for playing a ball game, including an exemplary embodiment of a ball striking apparatus mounted on an exemplary embodiment of a table.
Figure 2:
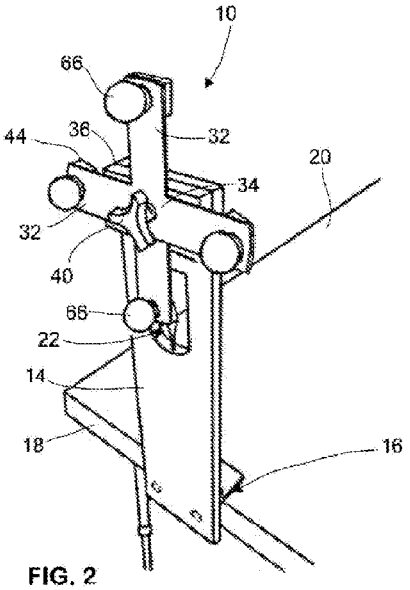
FIG. 2 shows a rear view of the ball striking apparatus of FIG. 1.
Figure 3:
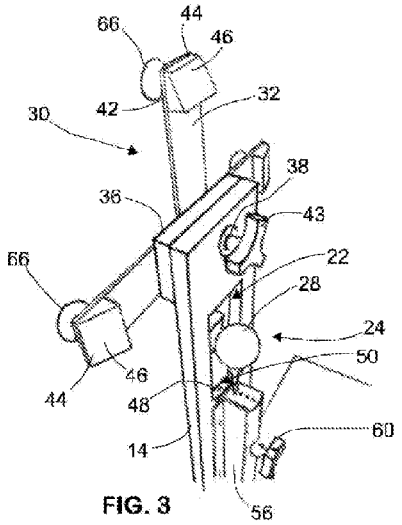
FIG. 3 shows a front view of the ball striking apparatus of FIG. 1.
Figure 4:
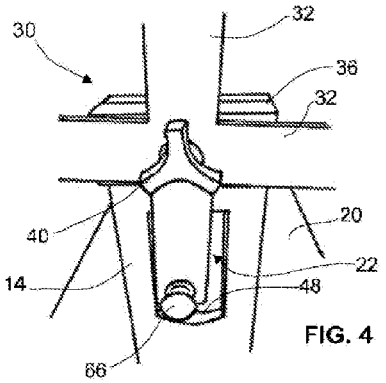
FIG. 4 shows a further rear view of the ball striking apparatus of FIG. 1.
Figure 5:
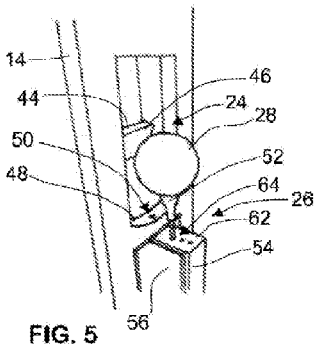
FIG. 5 shows a detailed view of a ball support arrangement of the ball striking apparatus of FIG. 1.

In FIGS. 1 to 6, reference numeral 10 generally indicates an exemplary embodiment of a ball striking apparatus for use with an exemplary embodiment of an apparatus for playing a game, generally indicated with reference numeral 12.

The ball striking apparatus 10 includes a support structure in the form of an elongate post or stanchion 14. The stanchion 14 is generally rectangular. A fastening assembly 16 is arranged on a lower end of the stanchion 14 for fastening the stanchion 14 to an edge 18 of a table 20 of the apparatus 12.

The stanchion 14 defines a generally rectangular opening 22 in an upper half of the stanchion 14. The opening 22 at least partially defines a primary impact zone 24. The zone 24 can also extend distally from the opening 22.

A ball support arrangement includes a ball support assembly 26 arranged with respect to the stanchion 14 to support a ball 28 in the zone 24.

A ball striking device 30 is mounted on the stanchion 14, above the opening 22. The ball striking device 30 includes a flat sheet of a resiliently flexible material that is shaped to define four resiliently flexible arms 32 extending from a hub 34 in a cruciform manner. The sheet can have a number of different characteristics, including material, depending on the required application. For example, the sheet can be of a plastics material, such as a polycarbonate material, for example Lexan™. Instead, the sheet can be of carbon fibre material. The sheet can be between about 1.6 mm and 5 mm, more particularly between about 2 mm and 4 mm thick, for example, about 3 mm thick.

The arms 32 can each have a width of between about 30 mm and 70 mm. More particularly the arms 32 can have a width of between about 40 mm and 60 mm, for example, 50 mm. The arms 32 can have a length of between about 100 mm and 200 mm. These dimensions can vary depending on the required performance characteristics of the device 30. The inventor also envisages that other materials may be required and, selected depending on the dimensions of the arms 32.

In this example, the stanchion 14 is in the form of a flat board of suitable material such as timber or a plastics material. For example, the stanchion can be of timber with a width of between about 120 mm and 180 mm, for example 150 mm and a thickness of between about 15 mm and 25 mm, for example, about 20 mm. A length or height of the stanchion 14 can vary for different applications.

A mounting plate 36 is fixed to an upper end of the stanchion 14 to provide a mounting surface that is proximally spaced with respect to the stanchion 14. The mounting plate 36 can have the same width and thickness as the stanchion 14 to be positioned flush with an upper end region of the stanchion 14.

The ball striking device 30 is mounted to the mounting surface and is rotatable in a generally vertical plane. Thus, the mounting plate 36 serves to inhibit interference between the arms 32 and the stanchion 14.

The ball striking device 30 is mounted to the mounting surface with a pivot bar or rod 38 (FIG. 3) that passes through the hub 34, the mounting plate 36 and the stanchion 14. A knob 40 is arranged on one end of the rod 38. The rod 38 is fully threaded. The knob 40 is a female knob that is threaded onto the rod 38. The rod 38 is threaded to engage a further knob 43 that is also a female knob that is internally threaded to engage the rod 38. Thus, the knobs 40, 43 can be rotated relative to each other to clamp the ball striking device to the mounting plate 36 or to release the ball striking device 30 from the mounting plate 36. In the released condition, the device 30 can be rotated so that a user can select one of the arms 32.

The arms 32 are dimensioned so that the device 30 can be rotated to bring an end region 42 of any of the arms 32 into alignment with the opening 22. The end region 42 is adjacent the impact zone 24 when the end region 42 is in alignment with the opening 22.

In that position, a selected arm 32 can be drawn back and subsequently released to be driven, as result of a bias, towards the zone 24. Thus, the arm 32 is effectively flicked towards the zone 24.

A ball strike member 44 is mounted on a distal side of each end region 42. Thus, the ball strike member 44 can be driven or flicked towards and into the strike zone 24.

Each member 44 has a different impact surface 46. For example, each member 44 is a wedge-shaped block that is glued to the end region 42. Each member 44 has a different wedge-shaped form with the impact surface 46 sloping towards an end of the respective arm 32. Thus, each impact surface 46 can impart a different degree of deflection to the ball 28 when striking the ball 28.

The ball support assembly 26 includes a hole 50 defined in a lower internal edge 48 of the opening 22. A tee 52 can be positioned in the opening 22 by inserting it into the hole 50. That way, the ball 28 can be positioned in the opening 22 to be struck by a selected impact member 44.

As can be seen in FIGS. 10 to 14, the ball support assembly 26 further includes a tee support member 54 that is mounted on a distal side of the stanchion 14 beneath the opening 22. The support member 54 is elongate and has a generally rectangular cross-section. The support member 54 is mounted between a pair of guide plates 56 in a generally vertical orientation so that the support member 54 can slide up and down between the plates 56. An adjustment mechanism 58 is arranged on the support member 54 and the stanchion 14 so that a vertical position of the support member 54 can be adjusted.

The adjustment mechanism 58 includes a slot 59 defined in the support member 54 and extending vertically. A shank 55 extends through the stanchion 14 and the slot 59. The shank 55 is threaded. An internally threaded, female knob 60 is threaded on to one end of the shank 55. A knob 63, which is also an internally threaded female knob, is threaded on to the shank 55. Thus, when the knobs 60, 63 are rotated relative to each other the support member 54 can either be clamped to the stanchion 14 or released from the stanchion 14 allowing adjustment by sliding the support member 54 up or down.

Thus, an upper surface 62 of the support member 54 is height-adjustable. The upper surface 62 includes a row of holes 64 (FIG. 5) that extends generally at right angles to the stanchion 14. Thus, a position of the tee 52 in the zone 24 can be adjusted.

Figure 15:
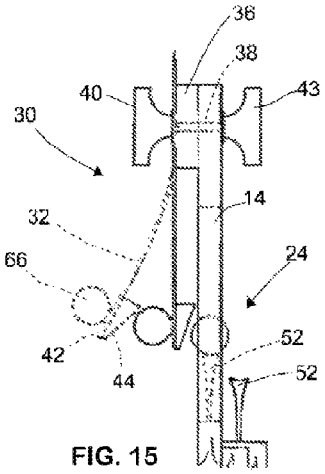
FIG. 15 shows a side view of the apparatus of FIG. 1, in use and imparting one form of trajectory to a ball.
Figure 17:
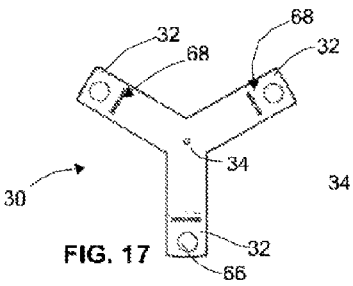
FIG. 17 shows a three-armed ball striking device selectively used as part of any one of the apparatus of the figures.
Figure 16:
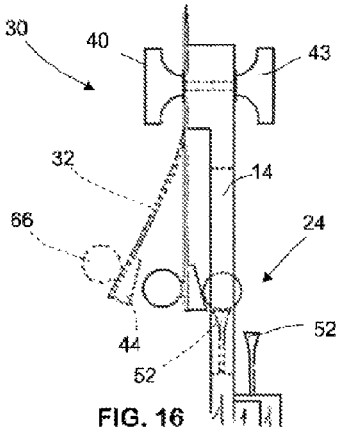
FIG. 16 shows a side view of the apparatus of FIG. 1, in use and imparting another form of trajectory to the ball.
Figure 18:
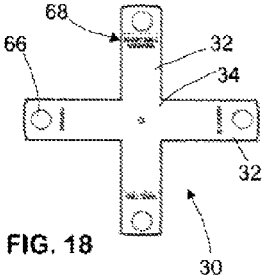
FIG. 18 shows a four-armed ball striking device selectively used as part of any one of the apparatus of the figures.
Figure 19:
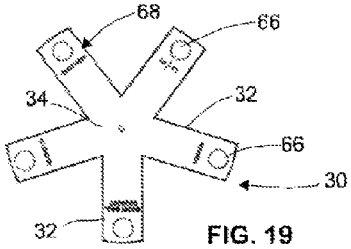
FIG. 19 shows a five-armed ball striking device selectively used as part of any one of the apparatus of the figures.
Figure 21:
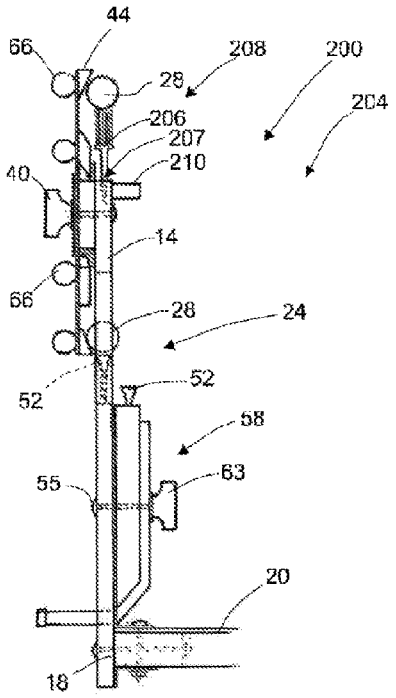
FIG. 21 shows a side view of a further exemplary embodiment of a ball striking apparatus for the apparatus for playing a ball game.
Figure 22:
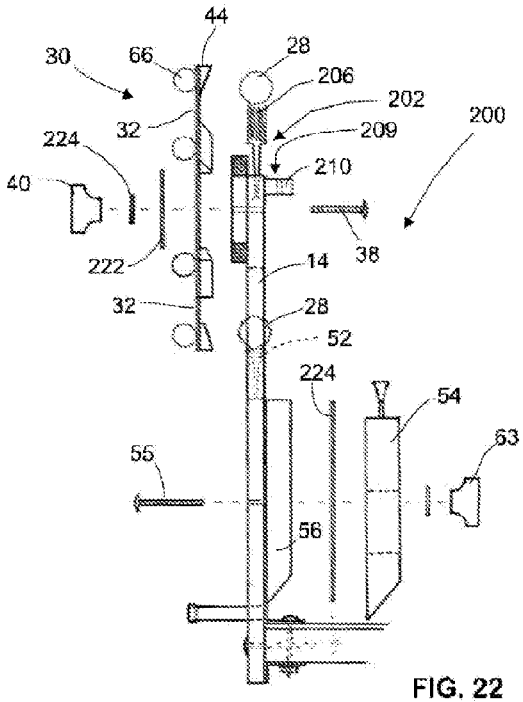
FIG. 22 shows a an exploded side view of the apparatus of FIG. 21
Figure 23:
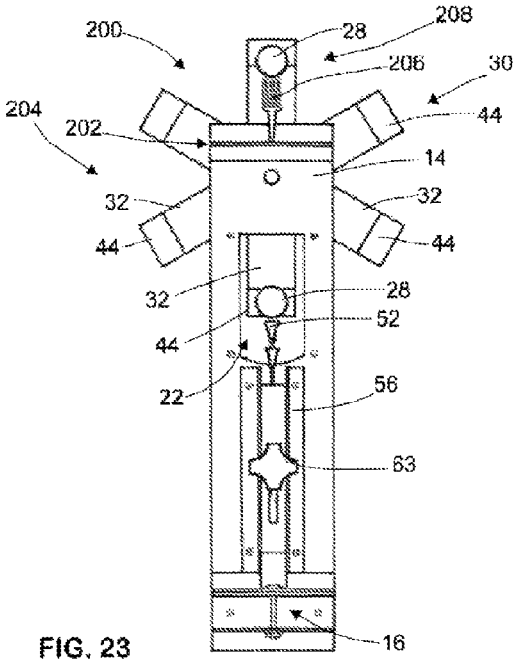
FIG. 23 shows a front view of the apparatus of FIG. 21.
Figure 24:
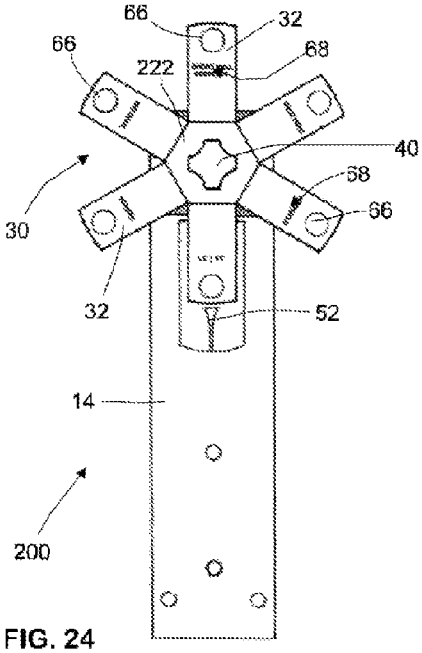
FIG. 24 shows a rear view of the apparatus of FIG. 21.
Figure 25:
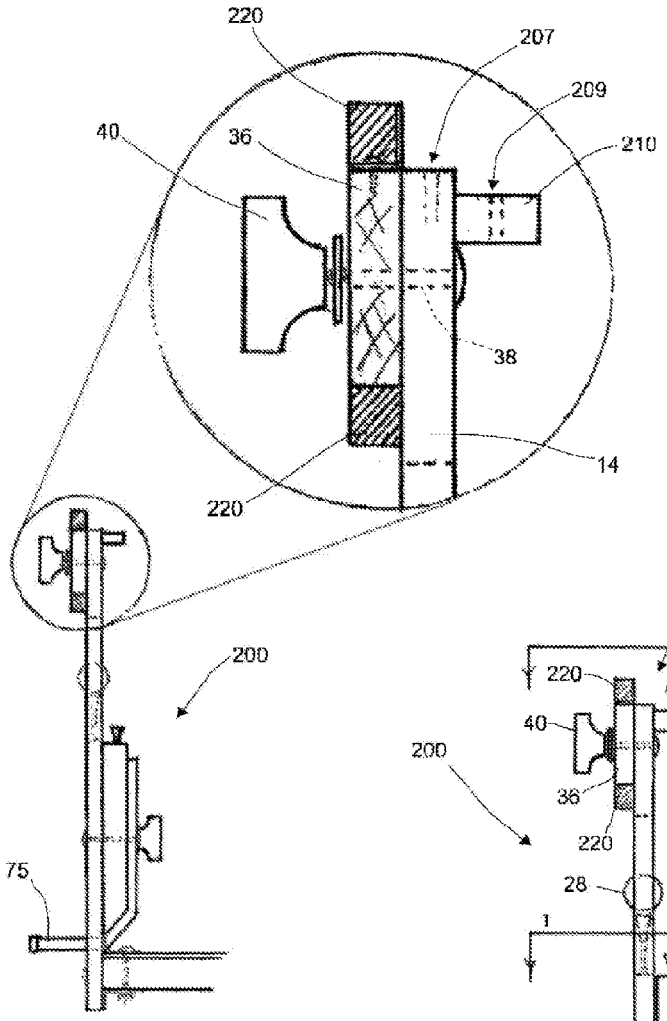
FIG. 25 shows a detailed side view of part of the apparatus of FIG. 21, excluding the ball striking device.
Figure 26:
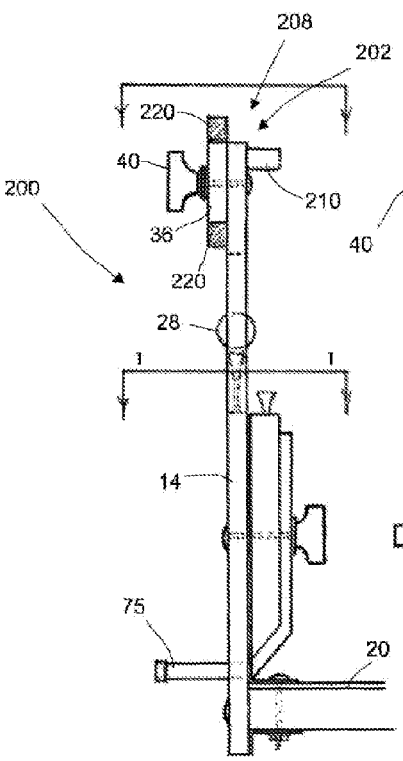
FIG. 26 shows a side view of the apparatus of FIG. 25.
Figure 27:
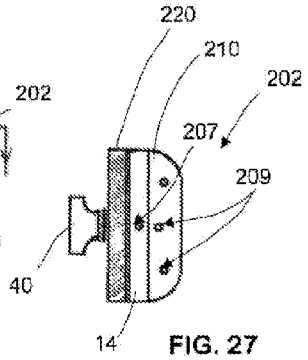
FIG. 27 shows a top view of the apparatus of FIG. 26.
Figure 28:
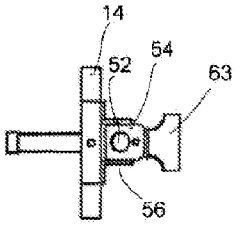
FIG. 28 shows a sectioned top view of the apparatus of FIG. 26, sectioned along section line I-I of FIG. 26.
Figure 29:
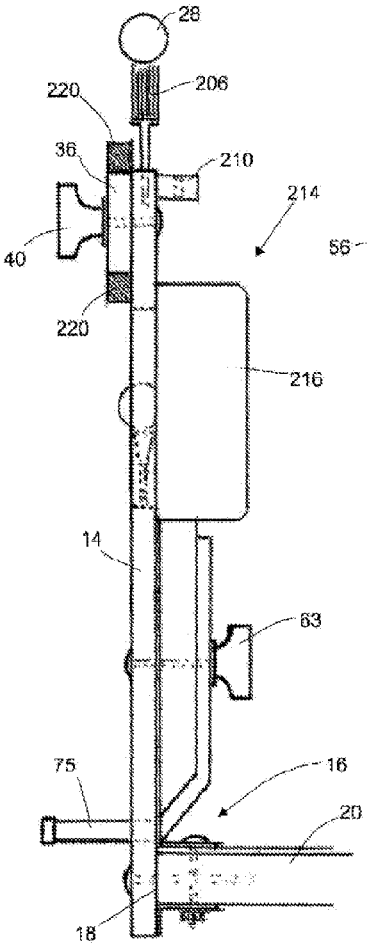
FIG. 29 shows a side view of the ball striking apparatus of FIG. 26, including a breeze guard for protecting the ball from a wind or breeze.
Figure 30:
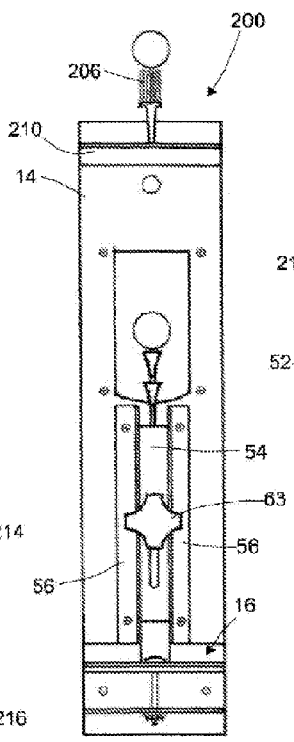
FIG. 30 shows a front view of the apparatus of FIG. 29, excluding the breeze guard.
Figure 31:
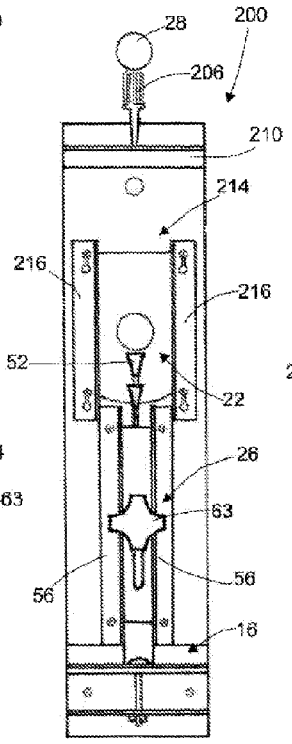
FIG. 31 shows a front view of the apparatus of FIG. 29, including the breeze guard.
Figure 32:
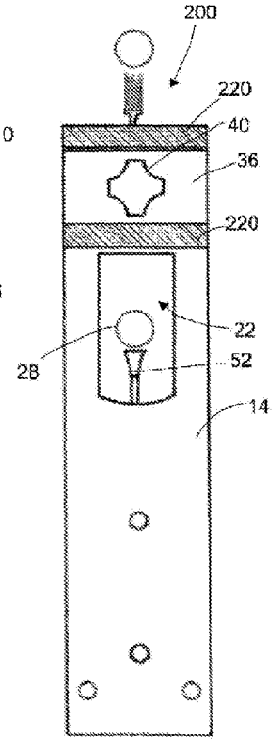
FIG. 32 shows a rear view of the apparatus of FIG. 29.
Figure 33:
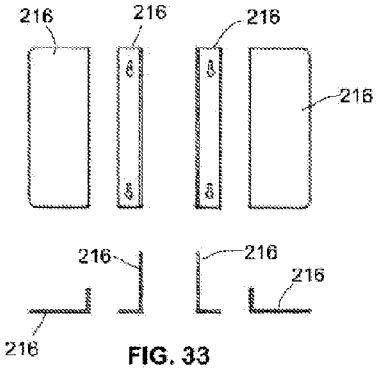
FIG. 33 shows a number of views of two screens of the breeze guard of the apparatus of FIG. 29.

As can be seen in FIGS. 15 and 16, the tee 52 can either be mounted in the lower internal edge 48 or on the support member 54.

A handle 66 is mounted on each end region 42 to extend proximally therefrom. Thus, a user can grasp any one of the handles 66 to bend the associated arm 32 away from the zone 24. Subsequently, the user can release the handle 66 so that the associated impact member 44 is flicked into and through the zone 24 to strike the ball 28.

It will be appreciated that the user can achieve different trajectories by selecting an appropriate arm 32 and position of the tee 52. Furthermore, the user can achieve some degree of directional adjustment by flexing or twisting the arm 32.

In FIG. 15, the arm 32 that has been selected has an impact member 44 with an impact surface 46 configured to impart a trajectory to the ball 28 so that the ball 28 bounces on the table 20. In FIG. 16, the arm 32 that has been selected has an impact member 44 with an impact surface 46 configured to impart a trajectory to the ball 28 so that the ball 28 reaches a batter without bouncing on the table 20.

The apparatus 12 can be suited for simulating a game of cricket. Thus, the apparatus 10 can be mounted on a minor edge 18 of the table 20 that is configured to represent a cricket pitch.

The table 20 can have a length of between about 3 m and 4 m, for example, about 3.6 m and a width of between about 40 cm and 80 cm, for example, about 60 cm. The inventor envisages that the table can be significantly longer, depending on the scale of the game being played.

Figure 6:
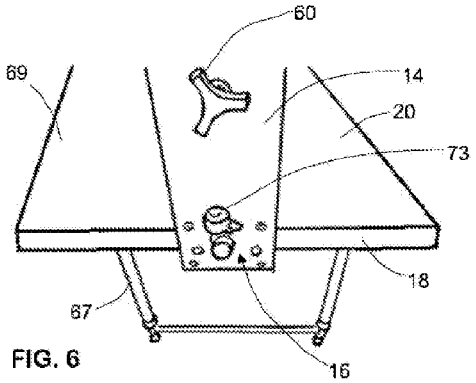
FIG. 6 shows a rear view of part of the ball striking apparatus of FIG. 1.
Figure 7:
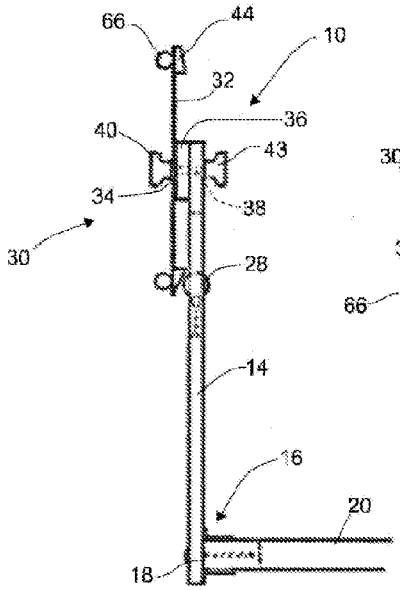
FIG. 7 shows a side view of a further exemplary embodiment of a ball striking apparatus for the apparatus for playing a ball game.
Figure 8:
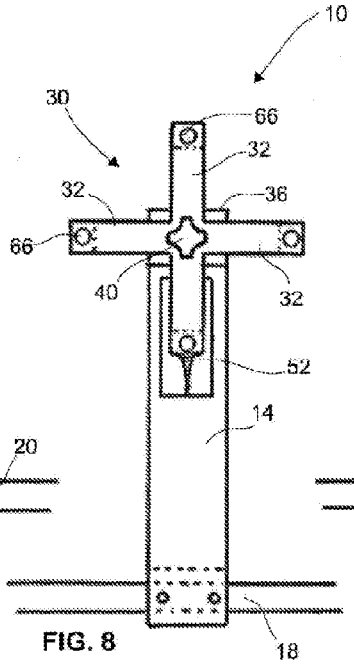
FIG. 8 shows a rear view of the apparatus of FIG. 7.
Figure 9:
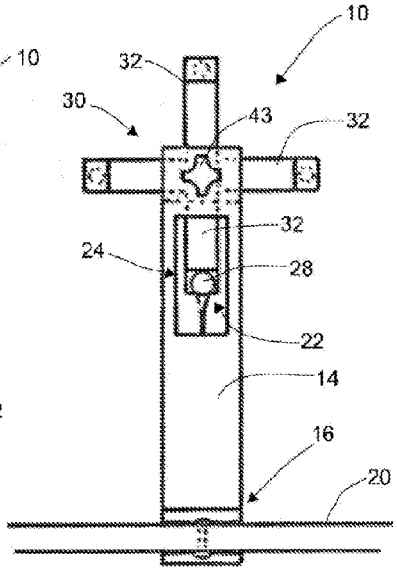
FIG. 9 shows a front view of the apparatus of FIG. 7.
Figure 10:
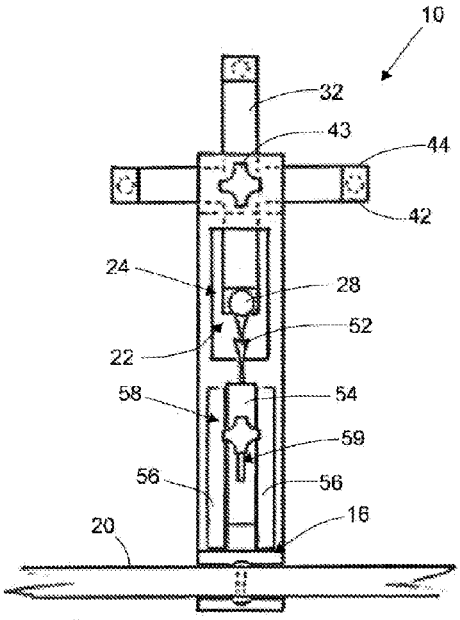
FIG. 10 shows a further front view of the apparatus of FIG. 1.
Figure 11:
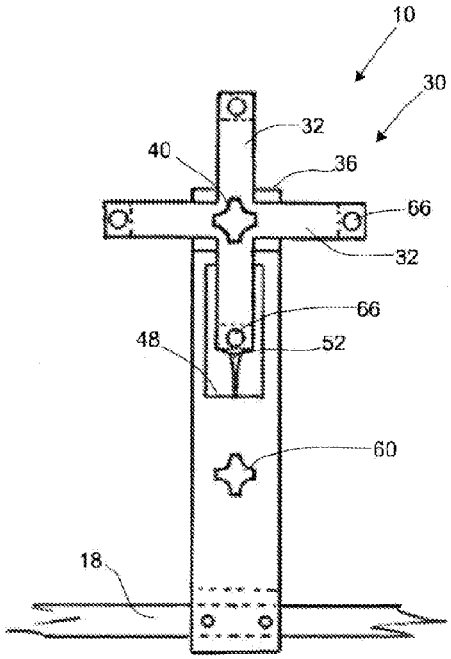
FIG. 11 shows a further rear view of the apparatus of FIG. 1.
Figure 12:
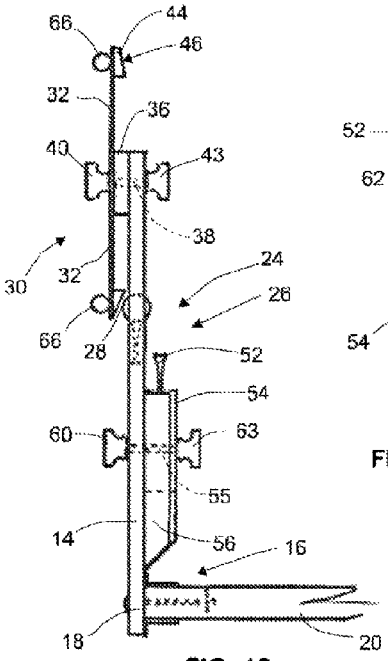
FIG. 12 shows a side view of the apparatus of FIG. 1.
Figure 13:
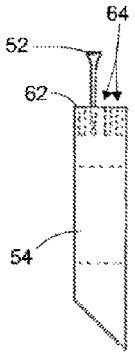
FIG. 13 shows a side view of a ball support arrangement of the apparatus of FIG. 1.
Figure 14:
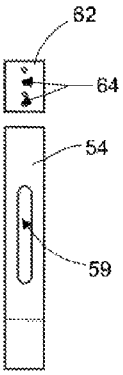
FIG. 14 shows plan and front views of the ball support arrangement of FIG. 13.

The table 20 can be provided with adjustable legs 67 (FIGS. 1, 6). The legs 67 can be configured to allow adjustment of the table 20 from about 40 cm to 90 cm to suit various heights and ages of users or players. The table 20 can also be configured to be capable of being folded up for storage and/or transport.

A surface 69 of the table can be painted or coated with suitable material such as paint. Lines can also be painted or otherwise demarcated on the surface to represent cricket crease lines 71.

In a cricket-simulating application, the impact members 44 are configured so that when the ball 28 is struck, the ball 28 assumes a velocity and trajectory that simulates a cricket ball in a real game of cricket.

Figure 20:
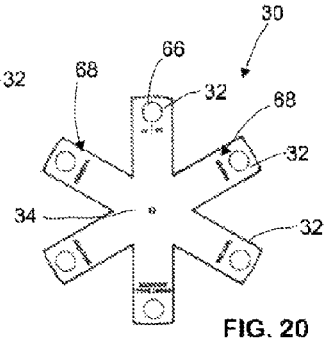
FIG. 20 shows a six-armed ball striking device selectively used as part of any one of the apparatus of the figures

As can be seen in FIGS. 17 to 20, the ball striking device 30 may have any number of equi-spaced arms 32 extending tram the hub 34. The ball striking device may have three arms (FIG. 17), four arms (FIG. 18), five arms (FIG. 19), or six arms (FIG. 20). The arms 32 can be labelled at 68 with information relating to the type of velocity and trajectory associated with different styles of bowling. For example, the labels 68 can carry words such as "Low Zone", "High Zone", "Mid Zone" for a baseball game, or "Good Length", "Yorker", "Short Ball", "Full Toss" or similar for a cricket game. The inventor envisages that the device could also have two arms or a single arm. There would be no limitation, other than structural, on the number of arms.

In FIGS. 21 to 33, reference numeral 200 generally indicates a further exemplary embodiment of a ball striking apparatus mounted on an exemplary embodiment of a table 20 and forming part of an apparatus 204 for playing a game.

With reference to the preceding drawings, like reference numerals refer to like parts, unless otherwise specified. However, any use of common reference numerals is not intended to limit the scope of the following description or the claims.

The main difference between the ball striking apparatus 200 and the ball striking apparatus 10, is the addition of a secondary ball support arrangement or assembly 202 elevated or higher relative to the ball support assembly 26. The secondary ball support arrangement 202 includes a secondary tee 206 on top of the stanchion 14 in a secondary impact zone 208. The secondary impact zone 208 is above the primary impact zone 24.

The secondary impact zone 208 and tee 206 allows for a ball 28 to be struck by an arm 32 from the 12 o'clock or upwardly extending position. The elevation of the secondary tee 206 above the tee 52 provides for the delivery of the ball 28 from a higher position than the tee 52 and striking of the ball 28 at a different angle. A ball 28 mounted on the tee 206 is struck by the arm 32 in the 12 o'clock position and the arm 32 follows through in a downward arcing path. In contrast, a ball mounted on the tee 52 is struck by the arm 32 in the 6 o'clock or downwardly extending position and the arm 32 follows through in an upward arcing motion.

The stanchion 14 has a hole 207 in the top surface thereof to receive the tee 206. The apparatus 200 further includes an upper support member 210 that extends generally at right angles to the stanchion 14. The upper support member 210 has one or more holes 209 to support the secondary tee 206, in an arrangement wherein the position of the secondary tee 206 in the secondary impact zone 208 can be adjusted.

The elevated position of the secondary tee 206 provides for a "bouncer" type delivery wherein the ball is delivered from an elevated position and angled sharply downwardly. The secondary tee 206 is preferably a brush tee.

The apparatus 200 includes a slip plate 224 seated between the guide plates 56. The slip plate 224 is located between the support member 54 and the stanchion 14. The slip plate 224 is of polycarbonate material.

The apparatus 200 may include a wind or breeze guard 214, as shown in FIGS. 29 to 33. The breeze guard 214 comprises two screens 216 which are mounted to the stanchion 14 on either side of the opening 22 and alongside the impact zone 24. The breeze guard 214 shelters the ball from side draughts of wind which may destabilise the ball or blow the ball from the tee 52.

The apparatus 200 includes resiliently deformable bumper stops 220 fixed to an upper and lower edge of the mounting plate 36. The arms 32 seat against the bumper stops 220 when the ball striking device 30 is mounted to the mounting plate 36. The bumper stops 220 are useful to lessen the recoil bounce effect on the arm 32 after the ball has been struck. The bumper stops 220 are of synthetic rubber material, or may be of any suitable resiliently deformable material.

The apparatus 200 includes a hexagonal gusset plate 222 fixed to the ball striking device 30. The gusset plate 222 is between the hub 34 of the ball striking device 30 and a washer 224. The gusset plate 222 is glued to the ball striking device 30 by silicon glue or the like. The gusset plate 222 strengthens areas of the device 30 where the legs 32 meet the hub 34, preventing cracks or tears where the legs 32 meet the hub 34. The gusset plate 222 is of the same material as the ball striking device 30.

The rod 38 of the apparatus 200 is a round-headed bolt 38. The head of the bolt 38 seats against the stanchion 14.

Figure 34:
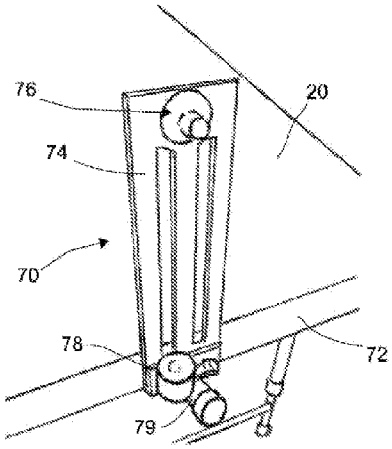
FIG. 34 shows a rear view of a wicket assembly of the apparatus of FIG. 1.
Figure 35:
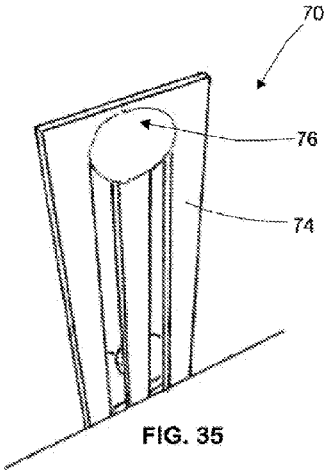
FIG. 35 shows a front view of the wicket assembly of FIG. 34.
Figure 36:
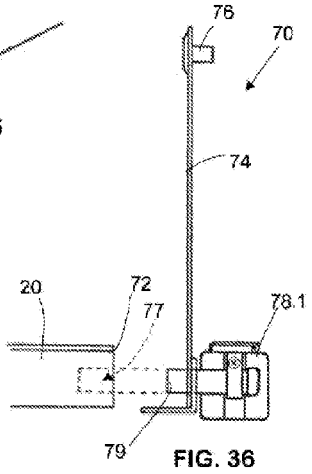
FIG. 36 a side view of the wicket assembly of FIG. 34 released from its position mounted to the table.

A wicket assembly 70 is mounted on an opposite edge 72 of the table 20 (FIGS. 34 to 36). The wicket assembly 70 includes a wicket member 74 that is formed from a sheet of a suitable material such as metal, timber or a plastics material. The wicket member 74 is shaped to define a pair of slits so that, overall, the wicket member 74 can represent a set of wickets. Furthermore, a size of the wicket member 74 is selected to be in proportion with a length and width of the table 20 to achieve a desired level of difficulty.

It will thus be appreciated that a user can use the ball striking apparatus 10 to drive the ball 28 towards the wicket member 74 as shown, for example, in FIGS. 15 and 16.

The wicket member 74 is formed from a sheet of material that is configured so that the wicket member 74 can vibrate when struck with the ball 28. The wicket assembly 70 includes a motion sensitive LED light assembly 76 of the type that is configured to activate when motion is detected. Thus, the LED light assembly 76 can be configured to activate when the wicket member 74 is struck with the ball 28.

It follows that it will be apparent to players that the wicket assembly 70 has been struck by the ball 28 during play.

A ringer, buzzer or whistle can be mounted on the wicket member 74 so that a player can indicate a return to the wicket assembly 70 during play as set out below. In this example, a manually operated bell 78, shown in FIG. 34, of the type that rings when struck is mounted on the wicket member 74 so that a player can strike the bell 78 when returning after a run. FIG. 36 shows a whistle 78.1 mounted on the wicket member 74. Reference 78.1 could also refer to a bell or buzzer.

The wicket assembly 74 is mounted to the table 20 by a rod or dowel 79 received in a hole 77 in the end 72 of the table 20 (FIG. 36).

A bell or buzzer can be mounted on a support 75 at the lower end of the stanchion 14 so that a player can be "run out" as will be explained below. In this example, a manually operable bell 73 is mounted on the lower end of the stanchion 14.

Figure 37:
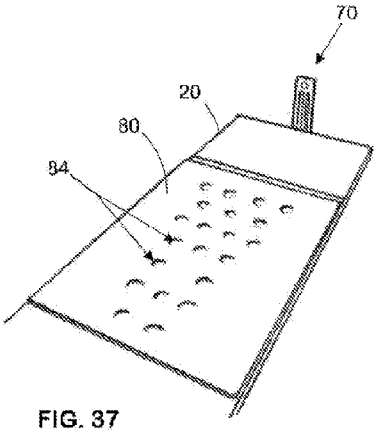
FIG. 37 shows a perspective view of an exemplary embodiment of a ball spin simulating pad or mat in position on a table of the apparatus of FIG. 1.
Figure 38:
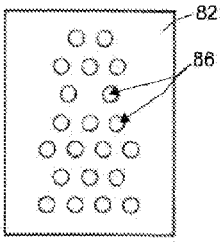
FIG. 38 shows a top view of another exemplary ball spin simulating pad for the apparatus of FIG. 1.
Figure 39:
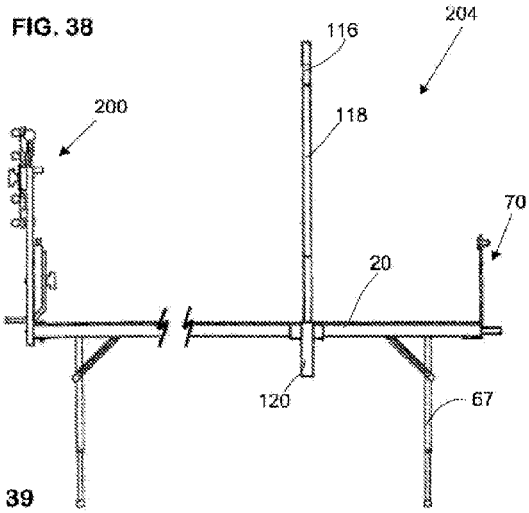
FIG. 39 shows a side view of the apparatus for playing a ball game, including the ball striking apparatus of FIG. 21.
Figure 40:
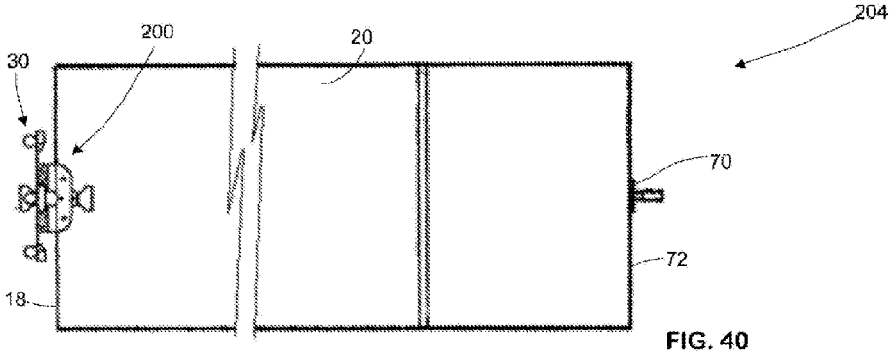
FIG. 40 shows a top view of the apparatus of FIG. 39.

In FIGS. 37 and 38, reference numeral 80, 82 respectively indicate a ball spin simulating pad or mat for positioning on the table 20 in an operative location relative to the wicket assembly 70.

The mat 80 includes a number of deflection formations in the form of recesses 84 that are defined by the mat 80. The recesses 84 are circular and dimensioned so that the ball 28 can be deflected by an edge of either of the recesses 84 when bouncing on or striking the mat 80.

The mat 82 includes a number of deflection formations in the form of projections 86 that are defined by the mat 82. The projections 86 are cylindrical and are dimensioned so that the ball 28 can be deflected by an edge or side of either of the projections 86 when bouncing on or striking the mat 82.

The recesses 84 and projections 86 are arranged in a suitable array on the mat 80, 82. Thus, a user can attempt to direct the ball 28 onto a suitable location on the mat 80, 82 to achieve a desired deflection of the ball 28 to simulate the effect of a spinning cricket ball striking a pitch.

An example of a suitable location for the mat 80, 82 is shown in FIG. 37. Thus the mat 80, 82 can be generally rectangular and can have the same width as the table 20. In use, the mat 80, 82 is positioned on a delivery side of the crease line 71 used by the batter.

The mat 80, 82 is of a relatively rigid material. For example, the mat 80, 82 is of plywood or similar. Otherwise, the mat 80, 82 can be of a plastics material.

Figure 41:
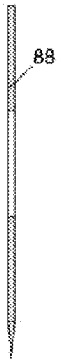
FIG. 41 shows a running marker post for the apparatus of FIG. 1.

FIG. 41 shows a running marker post 88. The post 88 can be of any suitable length. For example, it may be about waist height for an average adult. The post 88 can be suitably coloured. The post 88 can also be sharpened so that it can be driven into the ground or into a container carrying soil or sand. Use of the post 88 is described with reference to FIG. 43, below.

Figure 42:
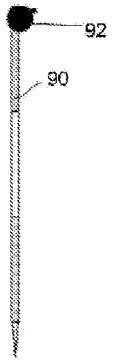
FIG. 42 shows a safe marker post for the apparatus of FIG. 1.

FIG. 42 shows a safe marker post 90. The safe marker post 90 is the same or similar to the running marker post 88. However, a bell or buzzer 92 is mounted on the post 90. Use of the post 90 is described with reference to FIG. 43, below.

Figure 43:
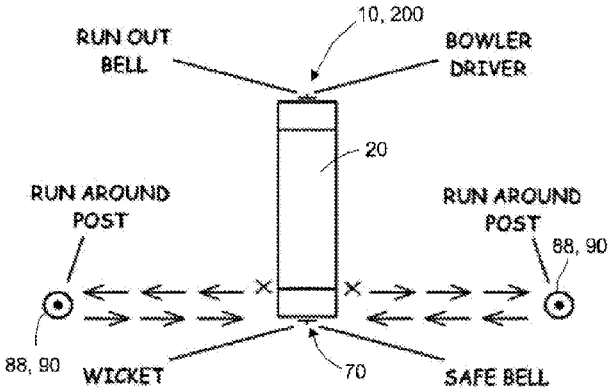
FIG. 43 is a diagram indicating a manner of use of the apparatus of FIG. 1.

FIG. 43 is a diagram indicating the manner in which the apparatus 12 is used.

One of the players uses the apparatus 10, in the manner described above, to strike the ball 28 so that the ball 28 can travel towards the wicket assembly 70. Another player is positioned with respect to the table 20 and is provided with a bat so that he or she can attempt to strike the ball 28. As in cricket, should the ball 28 strike the wicket assembly 70, the LED light assembly 76 flashes and the player is "out". Other players can also participate as fielders. Thus, should one of the players catch the ball 28 after the ball is struck, the player striking the ball or "batter" is "out".

The running marker posts 88 can be located in suitable positions with respect to the table 20. For example, if the batter is right-handed, the batter can stand on a left-hand side of the table 20 when viewed from the batter's perspective. If the batter is left-handed, the batter can stand on a right-hand side of the table 20. The posts 88 can be positioned on corresponding sides so that the batter is not required to run around the table 20. A right handed batter runs away from the table 20 to the run around post 88 to the left of the table 20 (or a position behind the table 20, not shown). Conversely, a left handed batter runs away from the table 20 to the run around post 88 to the right of the table 20 (or a position behind the table 20, not shown).

In order to make runs, the batter strikes the ball 28, runs around the appropriate post 88 and strikes the bell 78. It will be appreciated that it may be convenient for a run simply to be a single length from the batter to the post. In that case, instead of the posts 88, the safe marker posts 90 can be used. On reaching the posts 90, the batter strikes the bell or buzzer 92 indicating that the batter has made a run. The batter simply then walks back to the wicket assembly 70 and takes up his or her position at the "crease".

In cricket, a batter can also be "run out". Thus, a player can throw or pass the ball 28 to the player that has "bowled" the ball 28, while the batter is running so that the bowler can activate the bell 73 before the bell 78 is activated and the batter is "run out". As in cricket, a fielder can also activate the bell 73 before the bell 78 is activated so that the batter is "run out".

Figure 44:
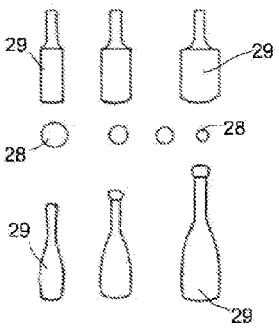
FIG. 44 shows front profile views of a number of embodiments of bats and balls of the apparatus for playing a ball game.
Figure 45:
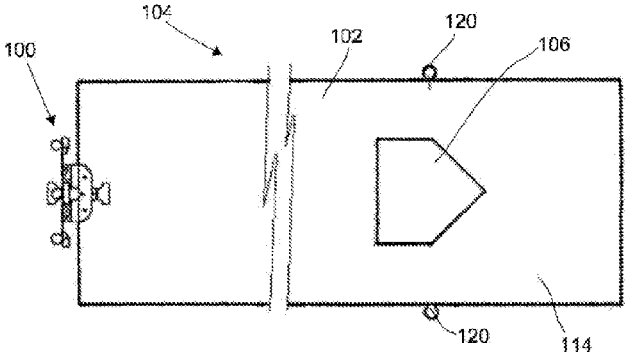
FIG. 45 shows a top view of another exemplary embodiment of an apparatus for playing a ball game, including an exemplary embodiment of a ball striking apparatus mounted on an exemplary embodiment of a table.
Figure 46:
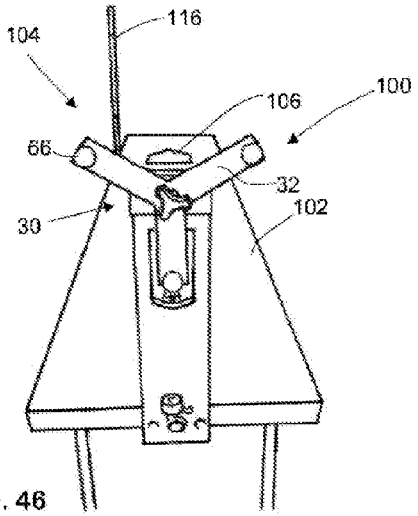
FIG. 46 shows a perspective rear view of the apparatus for playing a ball game of FIG. 45.
Figure 47:
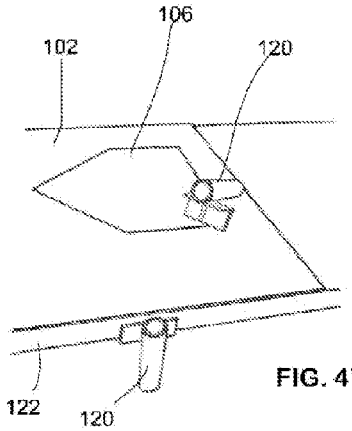
FIG. 47 shows a perspective side view of part of the apparatus for playing a ball game of FIG. 45, showing a mat demarcating a batter's plate.
Figure 48:
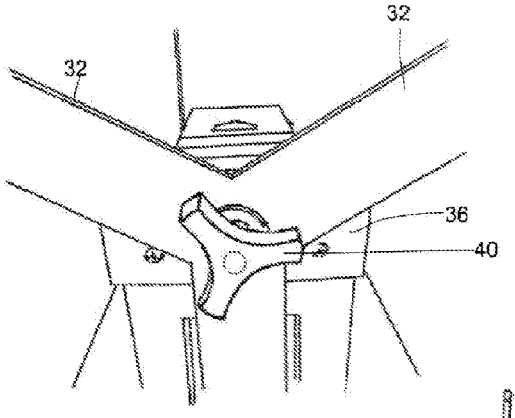
FIG. 48 shows a detailed perspective rear view of part of the apparatus for playing a ball game of FIG. 45.
Figure 49:
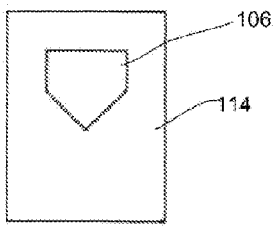
FIG. 49 shows a top view of the mat of FIG. 47.

The ball 28 can take a number of different forms. For example, the ball 28 can be a ping-pong or table tennis ball or similar. An example of a suitable ball 28 is one that is moulded of a relatively thin plastics material and capable of bouncing on a table such as a table used for table tennis. The ball 28 can thus be of various sizes. The sizes can range for example from about 30 mm to 60 mm. FIG. 44 shows a number of differently sized balls 28.

FIG. 44 shows a number of differently sized and shaped bats 29. It will be appreciated that various other types and sizes of bats 29 can be used. These might include miniature timber cricket or baseball bats for adult players or table tennis bats for younger players.

In FIGS. 45 to 50, reference numeral 100 generally indicates a further exemplary embodiment of a ball striking apparatus mounted on an exemplary embodiment of a table 102 and forming part of an apparatus 104 for playing a game.

With reference to the preceding drawings, like reference numerals refer to like parts, unless otherwise specified. However, any use of common reference numerals is not intended to limit the scope of the following description or the claims. Furthermore, the inventor envisages that components described with reference to the preceding drawings can be interchanged with components of the apparatus 100, where practical.

In this example, the apparatus 104 is suitable for playing a game that simulates baseball or softball. In baseball or softball, the ball is not supposed to bounce. Thus, the impact members 44 are selected so that the ball 28 can be struck in a suitable fashion to travel over a base plate 106 arranged or demarcated on the table 102.

The table 102 is also elongate and rectangular with the apparatus 104 mounted on a minor edge 108 in the same manner as the apparatus 12 is mounted on the table 20.

Instead of defining four arms, the ball striking device 30 defines three arms 32. In baseball or softball, a pitcher attempts to throw a ball at different levels through a strike zone. Thus, each of the arms 32 can be labelled at 110 with information regarding the nature of the trajectory of the ball 28. For example, the labelling can include words such as "high zone", "mid zone" and "low zone".

The table 102 is configured to represent a space between the pitcher's mound and the batter's box which is also referred to as the "keyhole".

In one example, the table 102 can have similar dimensions to the table 20 allowing a user to customise the table to suit either cricket or baseball. Thus, the base plate 106 can be defined by or demarcated on a mat 114 that is simply placed over an end portion of the table 102 to cover the existing crease line 71 and to be in alignment with the end and sides of that portion.

The mat 114 (FIG. 49) can be similar to the mat 80, 82 in material.

Figure 50A:
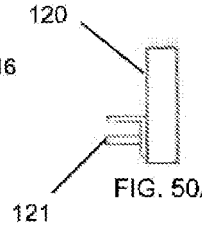
FIG. 50 shows a perspective view of part of the apparatus for playing a ball game of FIG. 45.
Figure 50:
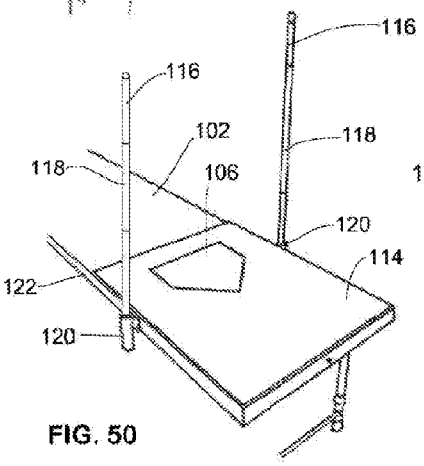

The apparatus 104 includes a strike zone marker post 116, two examples of which are shown in FIG. 50. The two posts 116 are shown in possible positions. It is not envisaged that the apparatus 104 will be used with both posts in that position and they are only shown in that configuration for convenience. The post 116 has a demarcation 118 intermediate its ends. The post 116 can be configured to suit players of different ages and heights. For example, the post 116 can be shorter with an appropriately dimensioned demarcation 118 for younger players or longer with an appropriate demarcation for older players.

Two tubular post holders 120 (FIGS. 47 and 50) are mounted on respective major side edges 122 of the table 102 adjacent the base plate 106. The holders 120 are configured to retain the post 116 in a vertical orientation. The demarcation 118 is configured so that it can be aligned with a strike zone above the base plate 106. Thus, the "pitcher" can attempt to strike the ball 28 with the device 30 so that the ball 28 can travel through the strike zone.

The provision of two holders 120 facilitates right-handed or left-handed batting. In particular, the post 116 can be positioned on either side of the table 102 to suit the batter. One of the holders 120 is shown in FIG. 50A. The holder 120 has a gripping, fixing or mounting arrangement 121 to allow the holder 120 to be attached to a side of the table in a releasable or removable manner.

Figure 51:
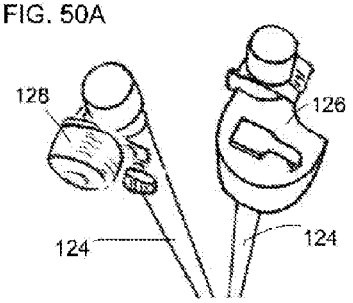
FIG. 51 shows two examples of safe marker post assemblies for the apparatus of FIG. 45.

The apparatus 104 includes a number of safe marker post assemblies or base pegs 124, shown in FIG. 51. Each of the base pegs 124 can be positioned with respect to the table 102 to represent bases for baseball or softball. The base pegs 124 may be mounted in a container of sand. The pegs 124 can be driven into the sand with the container located in a suitable position relative to the table 102

A bell 128 or tap down whistle or buzzer 126 can be mounted on an end of each peg 124 to be operated by a player running between the pegs 124.

Figure 52:
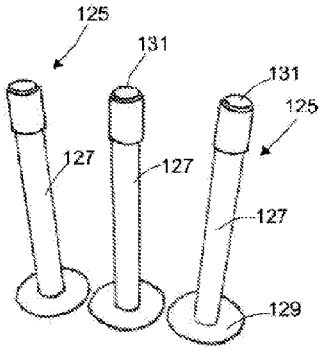
FIG. 52 shows further exemplary embodiments of safe marker post assemblies for the apparatus of FIG. 45.

In FIG. 52, there is shown three bollards 125 that can be used instead of the pegs 124. The bollards 125 each include a post 127 and an enlarged base or foot 129 to support the post 127 in a vertical position at a selected position representing a base. A button activated buzzer and/or light assembly 131 is mounted on an upper end of each post 127. Thus, when a batter reaches the bollards 125, he or she can strike the assembly 131 to indicate a "safe" condition. Alternatively, a fielder can receive the ball and strike the assembly 131 before the batter to indicate that the batter is "out".

The post 127 can be fabricated of PVC piping that is selected to be of a suitable weight to facilitate storage and conveyance.

It will be appreciated that the bollards 125 can also be used in the cricket simulating game described above instead of the marker posts 88.

Figure 53:
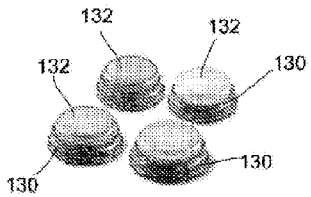
FIG. 53 shows examples of buzzers for use with an apparatus for playing a ball game.

Instead of using the bell 126, 128, buzzers 130, shown in FIG. 53 can be used. The buzzers 130 can be of different colours, depending on the use. It will be appreciated that the buzzers 130 can replace the bells used in the previously described embodiment, as well. The buzzers 130 can be of the types that generate light when struck. Thus, the buzzers 130 can have lenses 132 and associated LEDs of different colours.

In this embodiment, the ball 28 can be similar to that of the previous embodiment. However, in some instances, it can be desirable to have a larger ball, for example, up to or even over 55 mm in diameter.

Also, in this embodiment, the bat is selected to represent a baseball or softball bat shown in FIG. 44. This can be in the form of a wooden bat of pine or hardwood. However, for children, a bat of a plastics material would be more suitable for children, particularly since the strike area can be made larger without a significant increase in weight.

Figure 54:
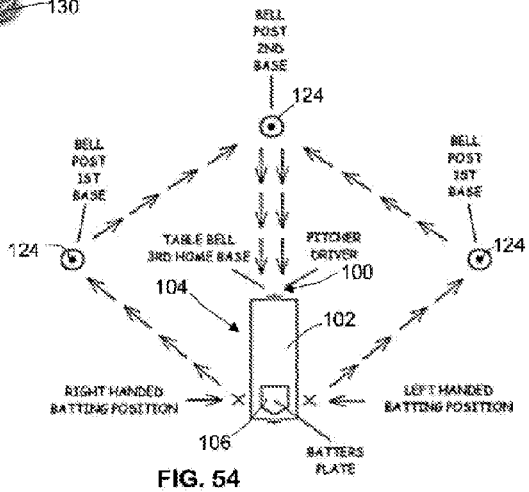
FIG. 54 is a diagram indicating a manner of use of the apparatus of FIG. 45.

FIG. 54 is a diagram indicating the manner in which the apparatus 104 can be used.

As can be seen, three base pegs 124 or bollards 125 are provided. Each of two base pegs 124 or bollards 125 can be positioned on respective sides of the table 102, while a third base peg 124 or bollard can be positioned behind the device 30.

It is to be understood that suitable mats can be used instead of the pegs 124 or bollards 125, if necessary. Such mats can simulate the mats that are used in baseball or softball.

In this example, at least five players are involved. These are the batter, the pitcher who operates the device 30 and a base keeper at each base peg 124.

In use, the pitcher uses the device 30 so that the ball 28 can be struck and "pitched" towards the batter. The batter can run between the base pegs 124. The batter can operate the bell 128 or buzzer 130 to indicate that he or she has arrived safely. Otherwise, the relevant base keeper can operate the bell 128 or buzzer 130 to indicate that the batter is out.

As can be seen in the diagram, the batter can run either clockwise or anticlockwise depending on whether he or she is right-handed or left-handed. A right handed batter runs away from the table 102 to the base peg 124 to the left and forward of the table 102 as the start of a clockwise run. Conversely, a left handed batter runs away from the table 102 to the base peg 124 to the right and forward of the table 102 as the start of an anti-clockwise run. The inventor envisages that players may make adjustments to the manner in which the apparatus used, depending on their particular circumstances.

Figure 55:
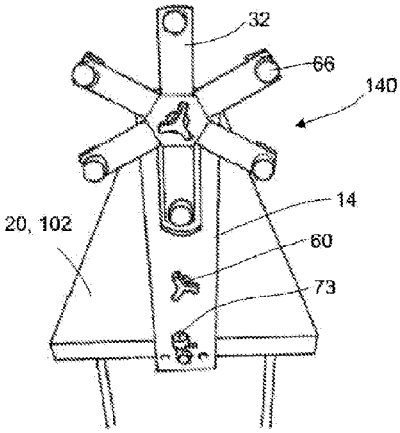
FIG. 55 shows a detailed rear view of another exemplary embodiment of a ball striking apparatus
Figure 56:
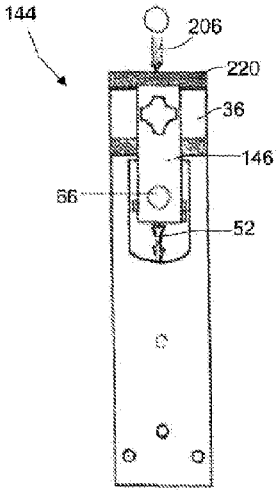
FIG. 56 shows a rear view of another exemplary embodiment of a ball striking apparatus.
Figure 57:
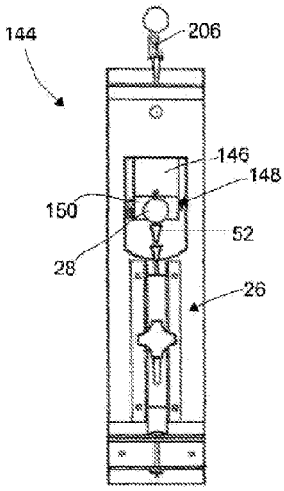
FIG. 57 shows a front view of the ball striking apparatus of FIG. 56.
Figure 58:
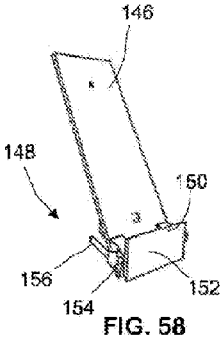
FIG. 58 shows an exemplary embodiment of an arm and ball impact assembly for use with the ball striking apparatus of FIG. 26, in one condition.
Figure 59:
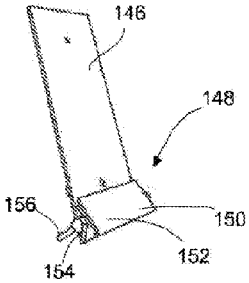
FIG. 59 shows the arm and ball impact assembly in another condition.

As mentioned above, the tables 20, 102 are interchangeable. Thus, an exemplary embodiment of a ball striking apparatus is indicated with reference numeral 140 in FIG. 55. With reference to the preceding drawings, like reference numerals refer to like parts, unless otherwise specified. However, any use of common reference numerals is not intended to limit the scope of the following description or the claims. Furthermore, the inventor envisages that components described with reference to the preceding drawings can be interchanged with components of the apparatus 140, where practical.

The device 30 includes six arms 32. Four of the arms 32 can be used for the simulated cricket game while three can be used for the simulated baseball game. It will be appreciate that the arm 32 that is suited for launching a "full toss" (cricket) will be suitable for the "low zone" (baseball/softball). The arms 32 can be labelled appropriately as shown in FIG. 20. The arm 32 that is suited for a "full toss" or "low zone" launch is labelled "LZ/FT" as can be seen in FIG. 20. Any variation in the number of arms 32 is also envisaged.

Instead of the device 30 with arms 32 that are adjustable in position, either of the apparatus 10, 104, 142 can include an alternative device 144 as shown in FIGS. 56 to 59. With reference to the preceding drawings, like reference numerals refer to like parts, unless otherwise specified. However, any use of common reference numerals is not intended to limit the scope of the following description or the claims.

The device 144 includes a single arm 146 that is fastened, at one end, to the mounting plate 36. The single arm 146 is generally rectangular and is formed from a sheet of a resiliently flexible material. Examples of such a material are a plastics material such as polycarbonate or a spring steel or any other material that can be used to generate a flicking action when withdrawn and released. The single arm 146 can be dimensioned similarly to the arm 32. A particular example of a suitable width is about 65 mm.

A ball impact assembly 148 is mounted on an opposite end of the arm 146. The arm 146 is dimensioned and fastened to the mounting plate 36 so that when withdrawn and released, the arm 146 can flick the ball impact assembly 148 through the impact zone 24.

The ball impact assembly 148 includes a ball strike member 150. The ball strike member 150 defines a ball impact surface 152. The impact member 150 is pivotally mounted on the arm 146 with an adjustable tilt mechanism 154. The adjustable tilt mechanism 154 is configured for operation by a user to alter an angle of the surface 152 relative to the arm 146. To that end, the mechanism 154 includes a handle 156 to release the impact member 150 so that a tilt of the surface 152 relative to the arm 146 can be adjusted. Once adjusted, the handle 156 can be used to tighten and secure the impact member 150 relative to the arm 146.

It follows that a player can adjust a trajectory imparted to the ball 28 by adjusting the tilt mechanism 154.

The stanchion 14 and the mounting plate 36 are configured to accommodate either of the devices 30, 144 described above.

In one example, either of the mats 80, 82 and the mat 114 can be provided in a single mat that is suitably configured. For example, the recesses 84 or projections 86 can be defined on one side of a single mat and the base plate 106 can be demarcated or otherwise defined on the other side of the single mat.

The inventor(s) envisages that the apparatus can be used to simulate other forms of ball sports. Furthermore, the apparatus can be used without reference to any other form of sport. Thus, it is to be appreciated that the simulations of cricket and baseball/softball are not intended to limit the scope of use of the apparatus.

In the above examples, the arms 32, 146 have a thickness of between about 3 mm and 4 mm when of a polycarbonate material. However, the inventor(s) envisages that longer and thicker arms can be provided with suitably scaled balls and tables to achieve an expanded version of the uses described above. Furthermore, the inventor(s) envisages that the apparatus need not be mounted on a table. For example, the apparatus could be mounted in a substrate such as the ground or in concrete. This would particularly be the case with scaled up versions of the apparatus which are intended to be within the scope of the above description and claims.

Throughout the specification, including the claims, where the context permits, the term "comprising" and variants thereof such as "comprise" or "comprises" are to be interpreted as including the stated integer or integers without necessarily excluding any other integers.

It is to be understood that the terminology employed above is for the purpose of description and should not be regarded as limiting. The described embodiments are intended to be illustrative of the invention, without limiting the scope thereof. The invention is capable of being practised with various modifications and additions as will readily occur to those skilled in the art.

Various substantially and specifically practical and useful exemplary embodiments of the claimed subject matter, are described herein, textually and/or graphically, including the best mode, if any, known to the inventors for carrying out the claimed subject matter. Variations (e.g., modifications and/or enhancements) of one or more embodiments described herein might become apparent to those of ordinary skill in the art upon reading this application. The inventors expect skilled artisans to employ such variations as appropriate, and the inventors intend for the claimed subject matter to be practiced other than as specifically described herein. Accordingly, as permitted by law, the claimed subject matter includes and covers all equivalents of the claimed subject matter and all improvements to the claimed subject matter. Moreover, every combination of the above described elements, activities, and all possible variations thereof are encompassed by the claimed subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any claimed subject matter unless otherwise stated. No language in the specification should be construed as indicating any non-claimed subject matter as essential to the practice of the claimed subject matter.

The use of words that indicate orientation or direction of travel is not to be considered limiting. Thus, words such as "front", "back", "rear", "side", "up", "down", "upper", "lower", "top", "bottom", "forwards", "backwards", "towards", "distal", "proximal" "in", "out" and synonyms, antonyms and derivatives thereof have been selected for convenience only, unless the context indicates otherwise. The inventor envisages that various exemplary embodiments of the claimed subject matter can be supplied in any particular orientation and the claimed subject matter is intended to include such orientations.

Thus, regardless of the content of any portion (e.g., title, field, background, summary, description, abstract, drawing figure, etc.) of this application, unless clearly specified to the contrary, such as via explicit definition, assertion, or argument, or clearly contradicted by context, with respect to any claim, whether of this application and/or any claim of any application claiming priority hereto, and whether originally presented or otherwise:

a. there is no requirement for the inclusion of any particular described or illustrated characteristic, function, activity, or element, any particular sequence of activities, or any particular interrelationship of elements;
b. no characteristic, function, activity, or element is "essential";
c. any elements can be integrated, segregated, and/or duplicated;
d. any activity can be repeated, any activity can be performed by multiple entities, and/or any activity can be performed in multiple jurisdictions; and
e. any activity or element can be specifically excluded, the sequence of activities can vary, and/or the interrelationship of elements can vary.

The use of the terms "a", "an", "said", "the", and/or similar referents in the context of describing various embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Moreover, when any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate sub range defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all sub ranges therebetween, such as for example, 1 to 3.65, 2.8 to 8.14, 1.93 to 9, etc.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

The invention claimed is:

1. A ball striking apparatus that comprises:

an elongate stanchion;

a fastening assembly for fastening the stanchion to an edge of a table that defines a playing surface, the fastening assembly arranged on the elongate stanchion;

at least one resiliently flexible arm that is mounted, at one end, to the stanchion with an opposite, free end adjacent a primary impact zone;

a ball strike member that is arranged on the opposite free end of the, or each, arm so that the free end of the, or each, arm can be drawn back manually and subsequently released to drive the ball strike member through the primary impact zone so that the ball strike member can strike a ball in the primary impact zone; and a ball support arrangement configured to support the ball in the primary impact zone such that the ball can be struck by the ball strike member and driven away from the primary impact zone.

2. The ball striking apparatus as claimed in claim 1, in which the stanchion is generally rectangular and defines an opening, the, or each, arm being positioned on a proximal side of the opening and the impact zone being located at at least one of the opening and a distal side of the opening.

3. The ball striking apparatus as claimed in claim 1, in which the ball strike member is arranged on the free end of the arm to extend at least partially into the opening when the arm(s) is in a released condition.

4. The ball striking apparatus as claimed in claim 3, in which the ball strike member has a profile that is selected to impart a degree of deflection to the ball when striking the ball.

5. The ball striking apparatus as claimed in claim 3, in which the ball support arrangement includes a ball support assembly that is mounted on a distal side of the stanchion, the ball support assembly being configured to support a tee in the primary impact zone.

6. The ball striking apparatus as claimed in claim 5, in which the ball support assembly is configured to support the tee in a range of positions in the primary impact zone.

7. The ball striking apparatus as claimed in claim 4, which includes a number of flexible arms and respective ball strike members mounted on the stanchion such that a user can select one of the arms for striking the ball with one of the ball strike members.

8. The ball striking apparatus as claimed in claim 7, in which a striking device is mounted on the upper end of the stanchion, the striking device defining the number of flexible arms extending from a hub in a spoke-like manner, the striking device being rotatable so that a user can rotate the device to select one of the arms and the associated ball strike member for striking the ball.

9. The ball striking apparatus as claimed in claim 8, in which the ball strike members have respective profiles that are different to each other so that a user can select a degree of deflection to be applied to the ball when struck.

10. The ball striking apparatus as claimed in claim 1, including a secondary ball support arrangement configured to support the ball in a secondary impact zone above or higher than the primary impact zone.

11. A ball striking apparatus that comprises:

a support structure;

at least one resiliently flexible arm that is mounted at one end to the support structure with an opposite, free end adjacent a primary impact zone;

a ball strike member that is arranged on the opposite free end of the, or each, arm so that the free end of the, or each, arm can be drawn back manually and subsequently released to drive the ball strike member through the primary impact zone so that the ball strike member can strike a ball in the primary impact zone;

a ball support arrangement configured to support the ball in the primary impact zone such that the ball can be struck by the ball strike member and driven away from the primary impact zone; and a secondary ball support arrangement configured to support the ball in a secondary impact zone above or higher than the primary impact zone, in which the secondary ball support arrangement includes an upper support member that is mounted on a distal side of the stanchion, the upper support member being configured to support a tee in the secondary impact zone.

12. An apparatus for playing a game, which comprises:

a ball striking apparatus that includes:

an elongate stanchion;

at least one resiliently flexible arm that is mounted, at one end, to the stanchion with an opposite, free end adjacent a primary impact zone;

a ball strike member that is arranged on the opposite free end of the, or each, arm so that the free end of the, or each, arm can be drawn back manually and subsequently released to drive the ball strike member through the primary impact zone so that the ball strike member can strike a ball in the primary impact zone; and a ball support arrangement configured to support the ball in the primary impact zone such that the ball can be struck by the ball strike member and driven away from the primary impact zone, the ball support arrangement including a ball support assembly that is mounted on a distal side of the stanchion, the ball support assembly being configured to support a tee in the primary impact zone; and a table that defines a playing surface so that the apparatus can be mounted on an edge of the table and the ball can be driven towards an opposite edge of the table.

13. The ball striking apparatus as claimed in claim 12, in which the ball support assembly is configured to support the tee in a range of positions in the primary impact zone.

14. The ball striking apparatus as claimed in claim 12, which includes a number of flexible arms and respective ball strike members mounted on the stanchion such that a user can select one of the arms for striking the ball with one of the ball strike members.

15. The ball striking apparatus as claimed in claim 14, in which a striking device is mounted on the upper end of the stanchion, the striking device defining the number of flexible arms extending from a hub in a spoke-like manner, the striking device being rotatable so that a user can rotate the device to select one of the arms and the associated ball strike member for striking the ball.

16. The ball striking apparatus as claimed in claim 15, in which the ball strike members have respective profiles that are different to each other so that a user can select a degree of deflection to be applied to the ball when struck.

* * * * *